US005501872A

United States Patent [19]

Allen et al.

[11] Patent Number: 5,501,872

[45] Date of Patent: Mar. 26, 1996

[54] METHOD AND APPARATUS FOR COATING A SIX-SIDED FIBROUS BATTING

[75] Inventors: Martin A. Allen; John T. Fetcko, both of Dawsonville, Ga.

[73] Assignee: Exxon Chemical Patents, Inc., Wilmington, Del.

[21] Appl. No.: 425,973

[22] Filed: Apr. 19, 1995

[51] Int. Cl.[6] ..... B05D 1/12

[52] U.S. Cl. ..... 427/180; 118/308; 118/310; 118/313; 118/314; 118/324; 425/72.2; 427/358; 427/389.9

[58] Field of Search ..... 118/308, 310, 118/313, 314, 324; 425/72.2; 427/180, 358, 389.9

[56] References Cited

U.S. PATENT DOCUMENTS 4,098,629 7/1978 Goldstone ..... 427/381 X 5,061,170 10/1991 Allen et al. ..... 425/197

5,145,689 9/1992 Allen et al. ..... 425/72.2

5,421,941 6/1995 Allen et al. ..... 156/244.11

5,445,509 8/1995 Allen et al. ..... 425/22.2

*Primary Examiner*—Michael Lusignan

*Attorney, Agent, or Firm*—Robert L. Graham; Douglas W. Miller

[57] ABSTRACT

A six-sided fibrous batting is coated with a nonwoven polymeric material by passing the batt sequentially through three coating stations. Four sides of the batt are coated in the first two stations and, after the batt is turned 90°, the final two sides are coated, completely encapsulating the batt in fibrous nonwoven coating.

12 Claims, 5 Drawing Sheets

METHOD AND APPARATUS FOR COATING A SIX-SIDED FIBROUS BATTING

BACKGROUND OF THE INVENTION

The present invention relates to a method and apparatus for coating and/or encapsulating a six-sided fibrous object or batting with thermoplastic material.

Insulating materials are frequently manufactured in the form of six-sided objects, referred to herein as batting, from fibrous materials such as rock fibers, glass fibers, slag fibers, wool fibers, and the like. These materials are used as thermal and acoustic insulators in a variety of applications. One problem associated with the fibrous batting is that its fibrous nature causes surface fibers to break away from the batting, particularly on handling. This not only can reduce the effectiveness of the insulator, but can also contaminate the atmosphere with fibers. In order to prevent this, it has been a common practice to coat the batting with a thermoplastic material. Preformed nonwoven web material composed of polymer fibers has been adhered to the surface of fibrous batting. These preformed layers become an integral part of the batting. This approach for coating the batting has not been entirely satisfactory because the adhesive used for securing the preformed layers to the batting may result in a fire hazard and also may detract from the insulation properties of the final product. Moreover, it is difficult to obtain a complete encapsulation of the batting.

PCT Application No. PCT/DK93/00064 discloses a method of applying a polymer coating onto a batting surface. The apparatus disclosed in the PCT application includes (a) a meltblowing die wherein micro-sized thermoplastic fibers are applied to a fibrous surface by the meltblowing process, and (b) melt spray nozzles wherein a gas/polymer mixture is applied to the fibrous surface.

With the melt spray apparatus, a number of nozzles arranged in a line across the surface to be coated discharge the gas/polymer stream onto the batting surface. A number of such nozzles, or pressure guns, can also be positioned circumferentially around the batting to coat four sides of the batting.

While the PCT application discloses coating four sides using the melt spray apparatus, it discloses only the coating of the upper and lower sides using the meltblowing apparatus. In the meltblowing apparatus, a suction device in accordance with the teachings of the PCT application is required to be positioned on the opposite side of the surface being coated. Because the batting generally is much wider than thick, the suction device could not be used in coating the sides of a thick batting.

Meltblowing offers the advantage over melt-spraying of producing a more uniform coating, but as demonstrated in the PCT Application, has not been successfully used to coat a six-sided batting by prior techniques.

Meltblowing is a term used in the nonwovens industry to describe a process wherein a series of thermoplastic filaments (or fibers) are extruded from a die while converging sheets of hot air contact opposite sides of the filaments imparting drag forces thereto. The drag forces draw down or stretch the filaments to microsize diameters and deposit them on a surface as randomly entangled fibers forming a nonwoven web. Nonwoven webs have been used as fibers, absorbents, and coatings to name a few.

SUMMARY OF THE INVENTION

The method of the present invention involves the sequential coating of opposite sides of a six-sided fibrous object with a thermoplastic meltblown material, whereby the fibrous object is completely encapsulated within the meltblown material. For purposes of describing the coating process, it is convenient to view the six-sided object as having four side surfaces and two end surfaces. The method comprises the following steps:

(a) passing the fibrous object between a first pair of meltblowing dies wherein two of the side surfaces located opposite one another are coated with meltblown thermoplastic fibers;

(b) passing the object through a second pair of meltblowing dies positioned in a plane which is at a right angle to the plane of at least one of the dies of the first pair of meltblowing dies, wherein the other two side surfaces of the fibrous object are coated with meltblown thermoplastic fibers; and (c) moving the object so that the end surfaces of the fibrous object pass in flanking relationship between a third pair of meltblowing dies, wherein the two end surfaces are coated with meltblown thermoplastic fibers.

In a preferred embodiment, the method is carried out in the following sequence: step (a), followed by step (b), and finally step (c). It will be appreciated that the sequence can be varied so that the end surfaces are coated first followed by coating the four side surfaces. The meltblowing dies are sized in relation to the surfaces of the object so that the coating on any surface will overlap slightly with the coatings on adjacent surfaces, whereby the object is completely encapsulated in the coating material.

DESCRIPTION OF THE PREFERRED EMBODIMENTS

Figure 2:
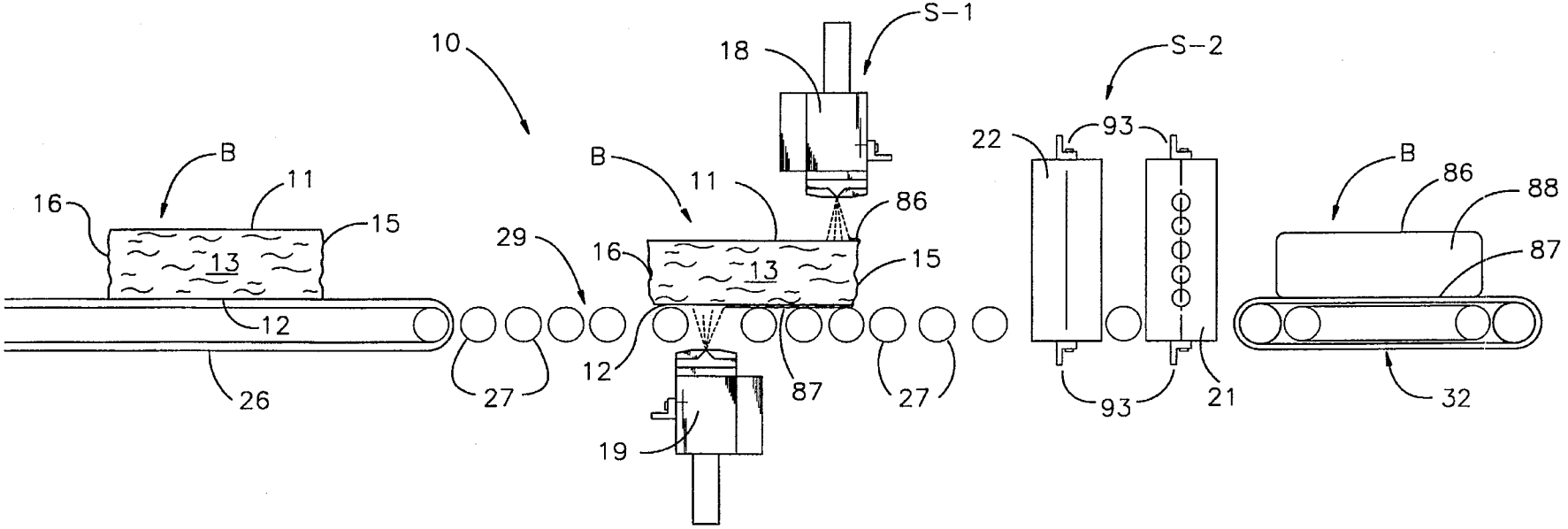
FIG. 2 is a side elevation of a portion of the system shown in FIG. 1 showing the apparatus for coating the four sides of the fibrous object.
Figure 5:
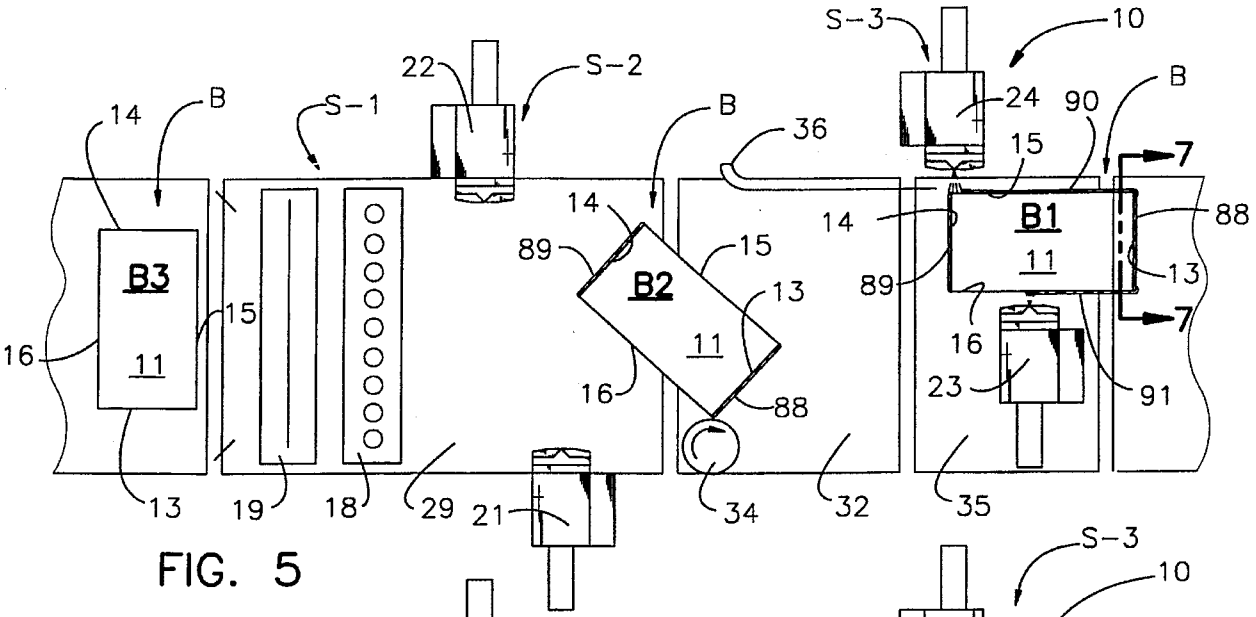
FIGS. 5 and 6 are top plan views schematically illustrating the movement of a fibrous batt through the apparatus of FIGS. 1 and 2.
Figure 6:
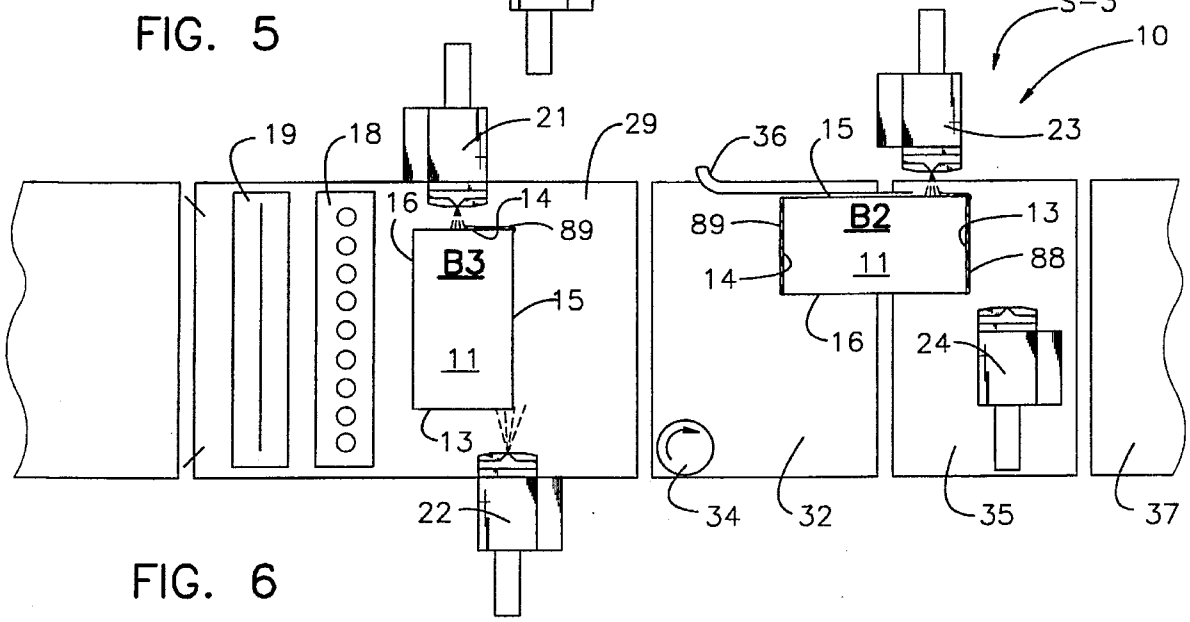

As mentioned above, the present invention relates to the complete coating (encapsulation) of a six-sided fibrous object, referred to herein as batting or batt. Battings used for insulation are generally formed as six-sided objects, the dimensions of which are such to permit easy installation. As shown in FIGS. 2, 5, and 6, the fibrous batting B comprises four side surfaces 11, 12, 13, and 14 and two end surfaces 15 and 16. The dimensions of the batting B may vary within a wide range, but generally the length is greater than the width, and the width is greater than the height. The length being the dimension of surfaces 15 and 16 as viewed in FIG. 5, the width being the dimension of surfaces 13 and 14 also viewed in FIG. 5, and the height being the dimension of surfaces 15 and 16 as viewed in FIG. 2. The dimensions of batting B are typically within the following ranges:

| | Range (mm) |
|---|---|
| length | 800–2000 |
| width | 100–400 |
| height | 50–150 |

For illustration purposes, sides 11 and 12 are referred to as the top and bottom surfaces, and sides 13 and 14 are referred to as the flanking surfaces. End surface 15 is the leading end surface and end surface 16 is the back end surface with respect to direction of movement of the batting B through the coating apparatus. As will be described, for coating end surfaces 15 and 16, batt B is rotated 90° (when viewed from the vantage of FIG. 5) so that after rotation, surfaces 15 and 16 become flanking surfaces with respect to the direction of motion. This position is illustrated as batt B1 in FIG. 5.

The fibrous batting B used for thermal and acoustic insulation may be made of a variety of fibrous materials such as rock fibers, glass fibers, slag fibers, wool fibers, and the like. The generic name for these fibrous materials is "mineral fibers".

Figure 1:
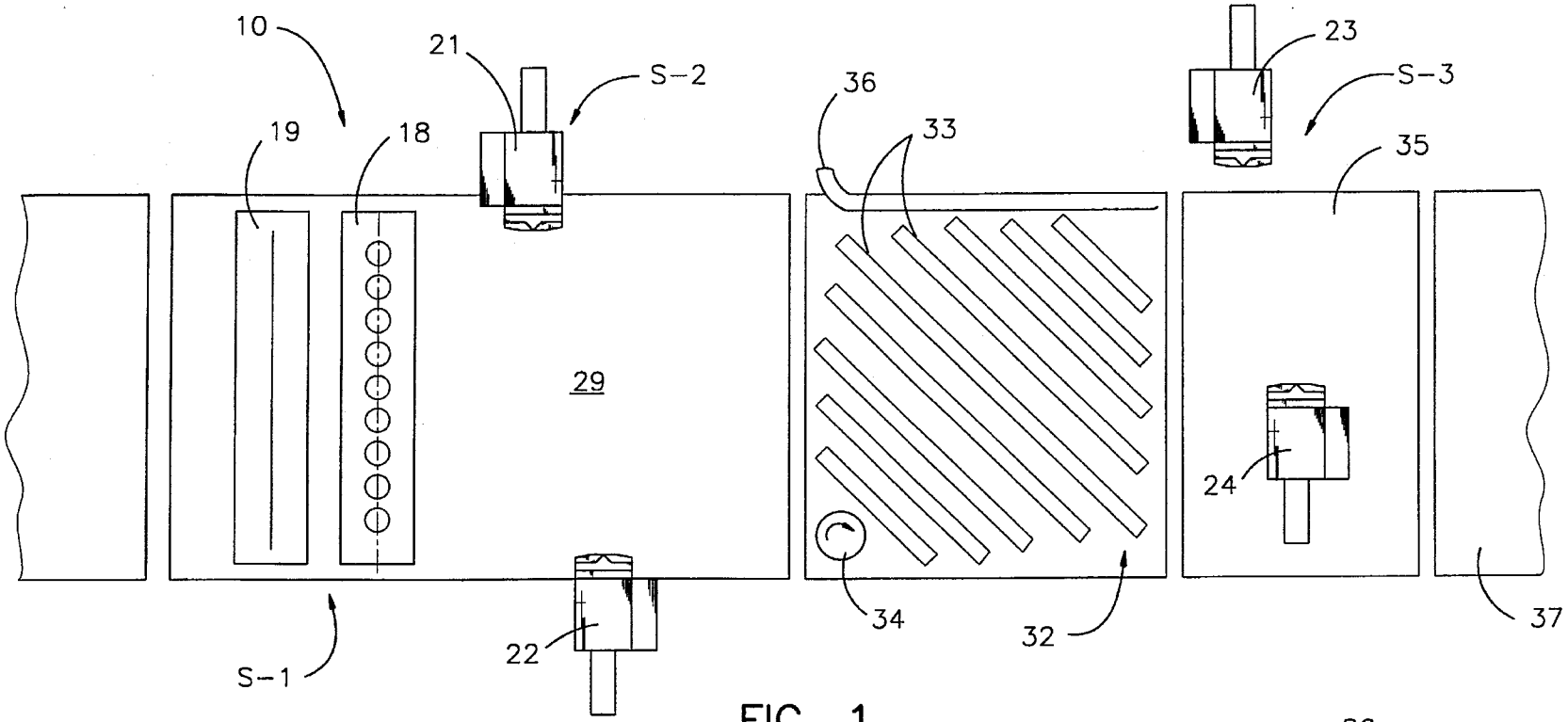
FIG. 1 is a top plan view, shown in schematic, of the apparatus and method of the present invention.
Figure 7:
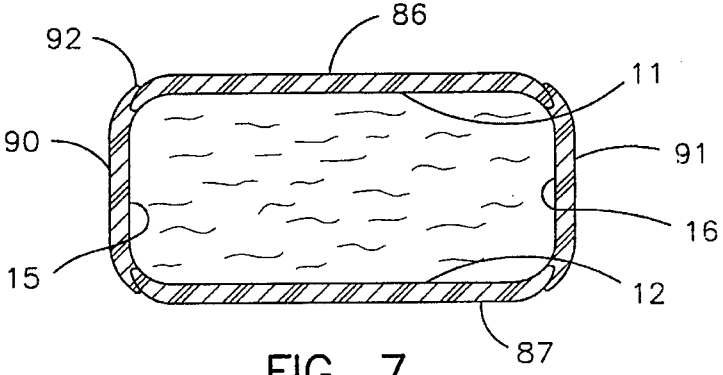
FIG. 7 is a cross-sectional view of a batting coated with a layer of thermoplastic fibers, with the cutting plane along line 7—7 of FIG. 5.

In a preferred embodiment, the apparatus line 10 for coating the fibrous batting is illustrated in FIG. 1 and comprises three coating stations: station S-1, station S-2, and station S-3. Each coating station includes a pair of spaced apart parallel meltblowing dies. Station S-1 comprises horizontal dies 18 and 19; station S-2 comprises vertical dies 21 and 22; and station S-3 comprises vertical dies 23 and 24. As illustrated in FIGS. 5, 6, and 7, each batting B passes sequentially through station S-1, station S-2, and station S-3. At each station two opposite sides of the batting B are coated so that upon leaving the coating apparatus, the batting B is completely encapsulated in the meltblown material. As illustrated, station S-1 applies coating to surfaces 11 and 12, station S-2 coats flanking surfaces 13 and 14, and station S-3 coats end surfaces 15 and 16, whereby batting B is encapsulated.

Conveyor

The coating line 10 includes means for conveying the batting B through each of the stations. The means may include belt conveyors and/or driven rollers. As best seen in FIG. 2, the conveyor for delivering the batting to the line 10 includes belt conveyor 26. The conveyor for stations S-1 and S-2 may comprise a series of elongate closely spaced driven rollers 27. For convenience of illustration, the conveying means for stations S-1 and S-2 is designated as conveyor surface 29 in FIGS. 1, 2, 5, and 6. The conveyor 29 extends for a sufficient length after station S-2 for the batting B to clear the dies of station S-2.

Between station S-2 and station S-3, a conveyor surface 32 is provided for turning the batting approximately 90° so that the batting passes through station S-3 with the end surfaces 15 and 16 in flanking relationship to the direction of movement, whereby the surfaces pass in confronting relationship to the spaced apart dies 23 and 24, respectively. The conveyor surface 32 may comprise a plurality of closely spaced rollers positioned at 45° with respect to batting movement. The angled rollers are illustrated as 33 in FIG. 1. Conveyor 32 may also include a plurality of rollers extending perpendicular to the direction of batting movement to move the batting in a linear direction once it has been turned 90°. The rollers define conveyor surface 35. Conveyor 32 is also provided with a vertical roller 34 for initiating the turning action on the batting. Guide rail 36 terminates the turning of the batt and serves to properly align the batt in relation to dies 23 and 24. The rollers are each driven, thereby providing the means for moving the batting B through the line 10.

Finally, conveyor 37 is provided to remove the batting B from the apparatus to a collection station (not shown). Conveyor 37 may be a belt conveyor.

The rollers defining conveyors 29, 32, and 35 preferably are of small diameter, in the range of two to three inches, and may be coated with a material such as rubber to promote batt movement.

Meltblowing Dies

The meltblowing dies 18, 19, and 21–24 may be of identical construction, except that the length may vary depending upon the dimension of the batting surface to be coated. Although a variety of meltblowing designs may be used, it is preferred that each die be of segmented construction with each segment having an internal valve for controlling polymer flow therethrough. Each die may, but need not, be of the construction described in detail in U.S. Pat. No. 5,145,689, the disclosure of which is incorporated herein by reference. The preferred meltblowing dies 18, 19, 21–24 useable in the present invention thus are of modular construction and capable of intermittent operation. The intermittent operation feature is important because it is necessary to interrupt meltblowing at each coating station when no batting B is disposed therein (i.e. between dies). It is also desirable that the dies used in the present invention be self-cleaning when shut down. Meltblowing dies that are not self-cleaning could become plugged by polymer setting up in the die orifices and passages during shut down periods. The die assembly disclosed in U.S. Pat. No. 5,145,689 is particularly suited for use in the present invention because it is of modular construction, and features intermittent and self-cleaning operation. Since the die assembly is disclosed in detail in said U.S. Pat. No. 5,145,689, it will be described only generally herein.

For convenience, only one die will be described, it being understood that dies 18, 19, and 21–24 may be of the same construction, except for the die length.

Figure 3:
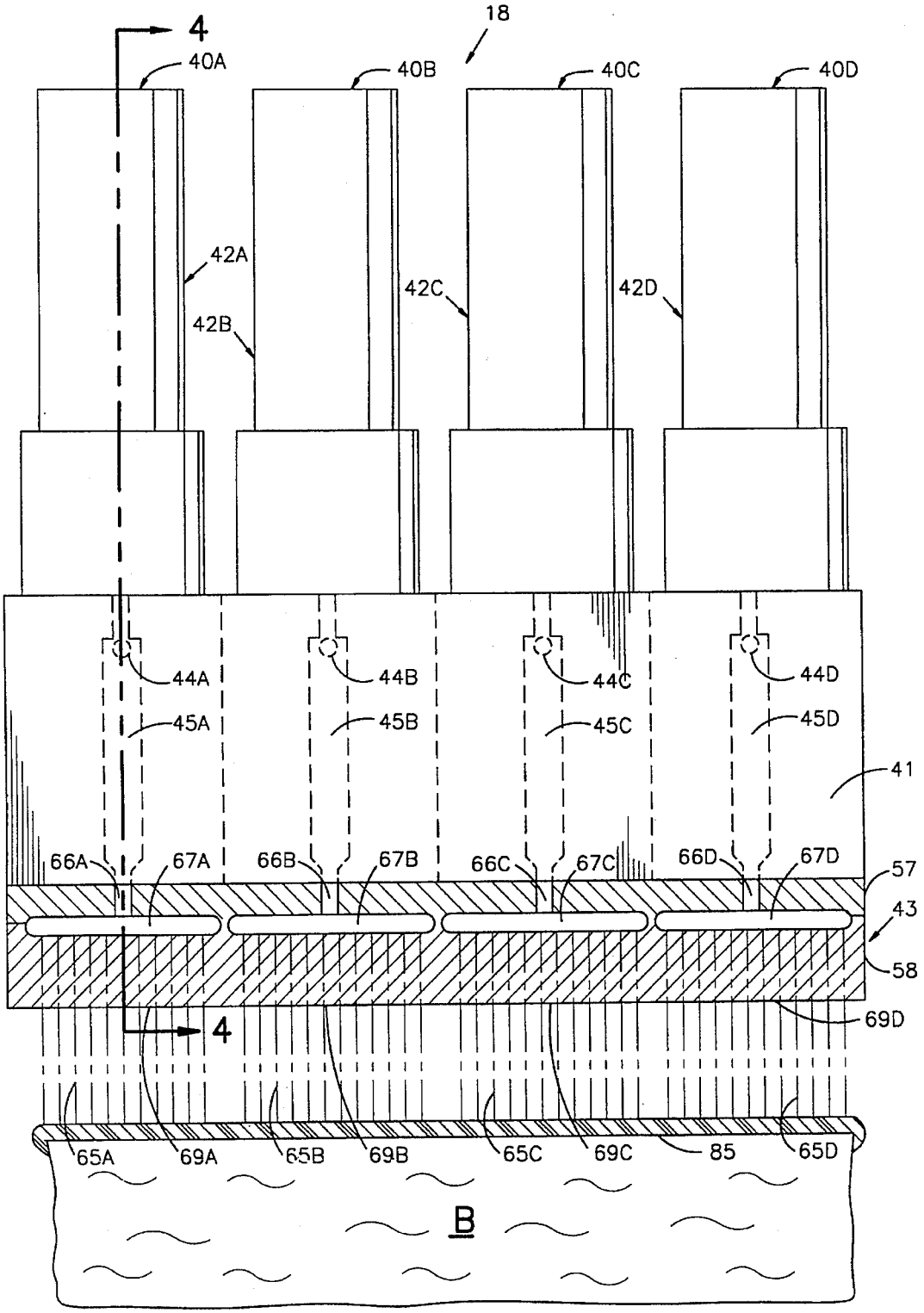
FIG. 3 is a front elevational view (with portions cut away) of a meltblowing die useable in the method and apparatus of the present invention.

With reference to FIG. 3, the die 18 comprises a body 41, meltblowing modules 40A–40D, and die tip assembly 43. A valve actuator 42A–42D is provided for each module. The length of the die body 41 and die tip 43, and the number of units 40A–40D and associated valve actuators 42A–42D may be varied to provide the coating of the desired dimension.

Figure 4:
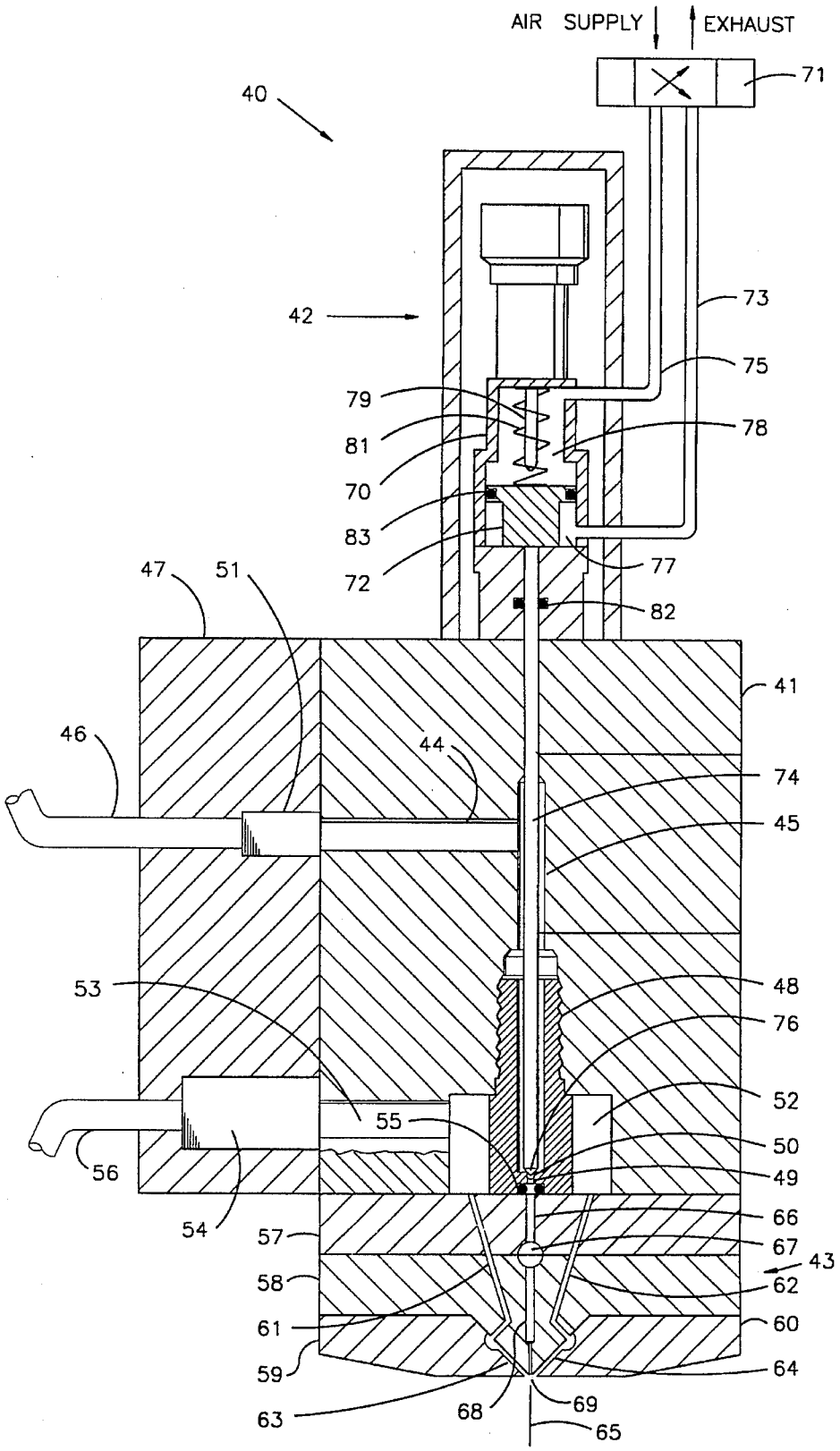
FIG. 4 is a longitudinal sectional view of a meltblowing die shown in FIG. 3 with the cutting plane taken generally along the line 4—4 thereof.

Only one of the units 40A–40D will be described in detail, it being understood that the polymer and air passages formed in all of the units will be generally the same. The description with reference to FIGS. 3 and 4 of unit 40 and its associated actuator 42 will be without letter designation. However, each of the units 40A–40D will have corresponding parts. The description with reference to FIG. 3 depicting more than one unit will include the letter designation to denote the separate units. Referring first to FIG. 4, die body 41 has formed therein intersecting polymer passages 44 and 45. Passage 44 connects to polymer feed line 46 through header manifold 47, and passage 45 is vertically aligned with valve actuator 42 and die tip assembly 43. Polymer feed line 46 is preferably a flexible hose.

The lower end of passage 45 is threaded for receiving insert 48 having port 49 formed therein. The inlet to port 49 is shaped to provide a valve seat at surface 50.

The polymer passage of each unit is fed by a balancing header 51 formed in manifold 47 in the form of a coat hanger spanning the inlets of passages 44 of each unit 40A–40D. The polymer flow through the body 41 is from line 46, through balancing header 51, through flow passages 44 and 45 of each unit in parallel flow, discharging through port 49 of each unit.

The bottom side of die body 41 has a machined out section which defines elongate air chamber 52. The circular inserts 48 of each unit mounted on the die body 41 separate the air chamber 52 from polymer flow passage 45. The air chamber 52 is continuous throughout the die body 41 and surrounds the inserts 48 of all the units. Sealing means such as o-rings 55 are provided to seal air chamber 52 and polymer passage 45.

A plurality of air passages, one shown as 53, extend through die body 41 into air chamber 52. The air passages 53 are distributed along the length of the die body 41 to provide generally uniform flow of air into chamber 52 at spaced locations. Air is fed by header 54 which may be formed in manifold 47. Hot air is delivered to the air passage 54 by flexible hose 56. The air is heated using in-line electric or gas heaters (now shown). Air thus flows from air line 56, through air header 54, in parallel flow through air passages 53, and into air chamber 52.

The die tip assembly 43 is mounted to the underside of the die body 41 and covers air chamber 52. This assembly comprises a stack up of three members: a transfer plate 57, a die tip 58, and air plates 59 and 60. Members 57, 58, 59, and 60 each extend substantially the full length of the die body 41 and in assembled relation are secured thereto by bolts (not shown).

Pairs of air passages 61 and 62 extend through the transfer plate 57 and the die tip 58. As best described in U.S. Pat. No. 5,145,689, air passages 60 and 61 comprise a plurality of passages equispaced along the length of the die for conducting air in parallel flow from chamber 52 into the die assembly. The air passages discharge into elongate air slits 63 and 64 defined by the confronting surfaces of the die tip 58 and air plates 59 and 60. The slits 63 and 64 converge as illustrated in FIG. 4 so that air passing therethrough forms a pair of air sheets which converge a short distance from the die discharge.

A central polymer passage 66 extending through the transfer plate 57 is aligned with port 49 and polymer passage 45 of the die body 41. As shown in FIGS. 3 and 4, the confronting surfaces of the transfer plate 57 and the die tip 58 have channels formed therein defining elongate end-to-end chambers 67 (67A–67D in FIG. 3). Each chamber (e.g. 67A) extends substantially the width of its associated unit (e.g. 40A), but is separated from its adjacent chamber (e.g. 67B) or chambers. The chambers 67 of each unit are longitudinally aligned and in combination extend substantially the entire length of the transfer plate 57. Extending from chamber 67 are a plurality of polymer flow passages 68 terminating in orifices 69 at the apex of the die tip 58. The orifices are referenced as 69A–69D in FIG. 3. The ends of each chamber 67 are preferably closely spaced apart so that the orifice spacing along the die tip are equally spaced substantially along the entire die tip length.

As best seen in FIG. 4, air flows from the chamber 52 through die assembly passages 61 and 62, through slits 63 and 64 exiting as converging sheets of hot air on each side of the row of orifices 69, while polymer flows through each unit passage 66, into chamber 67, through passage 68, and through orifices 69. The polymer melt discharges as a plurality of strands or filaments 65 which are contacted by the converging air sheets. The air sheets impart a drag force on the filaments which draws the filaments down to microsize diameters.

Each unit 40A–40D along the may have a length of ¾" to 4". The orifice spacing may range from 5 to 40 orifices per inch. The total number of units in a particular die will depend on the surface to be coated. For short dimensions, from 2 to 10 units may be satisfactory; for long dimensions, from 10 to 50 units may be required.

The construction and assemblage of die tip assembly 43 in relation to die body 41, and the configuration and number of air passages, polymer passages and chambers, may be as described in U.S. Pat. No. 5,145,689.

The modular valve actuators 42A–42D impart intermittent flow of polymer through the die body 41 and the die tip assembly for each unit. The intermittent is important for shutting off the dies while the batt is positioned between coating stations. The valve actuators 42A–42D may also be independently programmed to interrupt or initiate polymer flow through the meltblowing modules to produce a coating of varying width. For example, interrupting the flow through end modules 40A and 40D, while units 40B and 40C continue to operate, will result in a coating having only about half the width of that produced when all four units 40A–40D are in operation. This feature may be useful for coating batts of various sizes with the same coating apparatus 10.

The method for actuating each of the valves, as described and detailed in U.S. Pat. No. 5,145,689, comprises pneumatic piston 72 located within a cylinder defined by housing 70. The piston and the walls of the housing define lower air chamber 77 and upper air chamber 78. A fluid seal is established across piston 72 using o-ring 83. A valve stem 74 positioned in passage 45 has its upper end secured to piston 72 and moves therewith. The stem 74 extends downwardly into body passage 45 terminating at lower tapered end 76.

The valve is actuated by controls 71. The control 71 may be a solenoid, 4-way, two-position valve fed by an air supply. Electrical controls activate and deactivate the solenoid of the control valve 71. To activate polymer valve actuator 42, the solenoid is energized causing air flow from control valve 71 through line 73 into piston assembly lower chamber 77, while air in the upper chamber 78 exhausts through line 75 and control valve 71. Air pressure in chamber 77 causes piston 72 and the stem 74 to move upwardly. Stationary rod 79 limits the upward stroke of the piston and stem.

In the normal deactivated position of the valve module 42, spring 81 forces piston 72 and stem 74 downwardly until stem tip 76 seats on the valve seat 50 of port 49, thereby shutting off the polymer flow therethrough. Energization of the control valve 71 causes piston 72 and stem 74 to move upwardly opening port 49, permitting polymer to flow from passage 45 to die tip assembly 43. For sealing air chamber 77 and polymer passage 45, o-rings are provided as at 82.

In operation of each die 18, 19, and 21–24, hot air is continuously delivered to each die, while polymer melt is selectively delivered to each unit of the die by selectively actuating the control valves 71A–71D (not shown) of each unit 40A–40D. As polymer discharges from the orifices of the activated units (e.g. orifices 69A, 69B, 69C, and 69D shown in FIG. 3), converging sheets of air discharging from slits 63 and 64 (FIG. 4) contact the filaments 65 and stretch the filaments to microsize (e.g. 1 to 20 microns). The filaments 65 are deposited on the surface of the batt B in a random manner forming an entangled web of filaments thereon (i.e. nonwoven web) shown as coating 85 in FIG. 3. The integrity of the coating is provided mainly by mechanical entanglement of the fibers. The amount of web deposited on each batt surface may range from 5 to 20 gr./m$^2$, preferably 8 to 12 gr./m$^2$. Note that the filaments frequently are referred to as fibers or strands. These terms are used interchangeably herein to describe meltblown materials.

The coating 85 has been found to have excellent adhesion to fibrous batt B. The adhesion is due to a number of factors including interfiber entanglement between the coating and fibers of the batt cohesive sticking since the coating is applied to the batt in the molten or semi-molten state, and frictional forces.

Returning to FIG. 2, die 18 is positioned above conveyor surface 29 to coat the top side 11 of the batt B, and die 19 is positioned below the conveyor surface 29 to coat the bottom surface 12 of the batt B. Note that there are no rollers 27 immediately above die 19. The coatings produced by dies 18 and 19 are illustrated as coatings 86 and 87, respectively, in FIGS. 2 and 7.

In station S-2, dies 21 and 22 similarly coat the uncoated sides 13 and 14 of the batt B with a nonwoven web. FIG. 5 depicts these coatings as 88 and 89. Note that there is an overlap of the coatings at the four edges (see FIG. 7) to ensure complete coverage and good adhesion by the nonwoven webs.

In station S-3, the batt has been turned 90° so that end surfaces 16 and 17 occupy the flanks of the batt B. Passage of the batt B in this position through the dies 23 and 24 of station S-3, places the side surfaces in confronting relationship to the filaments discharged from the dies, completely coating and encapsulating the batt B with a nonwoven web. As shown in FIGS. 5 and 7, coatings 90 and 91 are applied to surfaces 15 and 16, respectively. As best seen in FIG. 7, dies 23 and 24 are positioned to provide a slight overlap at the edges, as at 92, to ensure complete coating and good adhesion.

The nonwoven coatings 86–91 adhere to the batt and in the overlapped areas by mechanical entanglement without the need of adhesives which could alter the insulation and/or permeability properties of the batts.

The spacing of each die from the batt will typically be in the order of 6 to 9 inches. The structure for mounting the dies in the proper position can be by any frame or mechanical support means. For clarity, the mounting structure has not been shown. However, support members 93 are shown bolted to dies 21 and 22. Each member 93 extends transversely across the conveyor surface 29. The dies thus can be moved laterally to provide the desired spacing. Similar mounting members can be provided on dies 23 and 24 to permit lateral adjustment; likewise, vertical mounting members can be provided on dies 18 and 19 to permit vertical adjustment of dies 18 and 19.

The polymer used to coat the batting may include a wide range of polymers used in meltblowing to form nonwoven webs. These can be any one of the variety of thermoplastics used in meltblowing operations. The typical meltblowing web forming resins include a wide range of polyolefins such as propylene and ethylene homopolymers and copolymers. Specific thermoplastics include ethylene acrylic copolymers, nylon polyamides, polyesters, EMA, polystyrene poly(methyl methacrylate), silicone sulfide, and poly(ethylene terephthalate), and blends of the above. The preferred resin is polypropylene. The above list is not intended to be limiting, as new and improved meltblowing thermoplastic resins continue to be developed. These resins, particularly polypropylene, are oleophillic and therefore ideally suited for oil cleanup. The polymer melt may be delivered to each die by conventional extruders or a polymer melt delivery system described in U.S. Pat. No. 5,061,170, the disclosure of which is incorporated herein by reference. The hot air may be provided by use of conventional furnaces or electric heaters. The temperature of the polymer melt and the air are exemplified in the Example below.

Operations

FIGS. 2, 5, and 6 illustrate the dispositions of the batt B along line 10, through coating stations S-1, S-2, and S-3. The coating process will be carried out automatically and will process individual batts at frequent time intervals. As shown in FIG. 5, batt B1 is passing through station S-3, batt B2 has passed station S-2 and is in the process of being turned 90°, and batt B3 is being conveyed into station S-1.

The process for coating each batt will be as follows.

Conveyor 26 transports the batt B onto conveyor 29 defined by rollers 27 (see FIG. 2). The batt B upon passing over die 19 actuates operation of that die wherein side surface 12 is coated with coating 87. Further movement of the batt brings it directly under die 18 which is automatically actuated to apply coating 86 to surface 11 of the batt B. As the batt B clears dies 19 and 18, each die automatically shuts off. Upon entering station S-2, die 22 is actuated coating side 14 with coating 89 as shown in FIG. 6. Further movement of the batt in station S-2 activates die 21 which coats side surface 13 with layer 88. Dies 21 and 22 also are automatically shut off following the coating step. Further movement of the batt along roller conveyor 29 brings the leading surface 15 into contact with continuously rotating roller 34. This action, in combination with the angled rollers 33 (see FIG. 1), causes the batt to turn 90°. FIG. 5 illustrates batt B2 in the process of being turned. The batt is moved on conveyor 32 until it contacts guide rail or wall 36 placing it in the position of batt B2 in FIG. 6. The rollers of conveyor 35 move the batt B2 into confronting relationship with dies 23 and 24 where the dies automatically coat end surfaces 15 and 16 with coatings 90 and 91. The batt is thus completely encapsulated in the nonwoven web, which overlaps at the edges of the batt as illustrated in FIG. 7. Finally the batt is moved onto conveyor 37 where it is removed from the line to a collection area.

Actuating for automatically controlling the on/off operation of the dies in timed relation to the movement of the batts can be accomplished using optical sensors (not shown). A typical configuration would comprise a light or light beam source placed on one side of the conveyor line and focused on a light detecting sensor on the opposite side of the conveyor. The sensor may be any number of sensors commercially available, such as photodiodes. The light source and sensor will be positioned in front of the die to be actuated so that when a batt moves between the source and the sensor the light transmitted therebetween will be interrupted thereby activating the sensor. The sensor will produce an electrical signal which may be wired to polymer valve actuators 42 for turning the die on. Once the batt has moved beyond the die, the light transmission between the source and sensor will resume and the sensor will produce a signal for shutting the die off. A number of sources and sensors may be required. A variety of actuation methods are possible as would be appreciated by one of ordinary skill in the art of electronic controls.

EXAMPLE

A six-sided batt was coated with polypropylene meltblown web using the line described above. Details of the batt and line were as follows:

| Batt: | | |
|---|---|---|
| | Material: | Mineral, wool and slag |
| | Dimensions: | length/width/height: |

-continued

| Dies: | Use: | 1200 mm/200 mm/90/mm Building insulation | |
|---|---|---|---|
| | Station S-1 | Station S-2 | Station S-3 |
| Each die length (cm) | 122 | 23 | 3 |
| Units (no.) | 32 | 9 | 9 |
| Unit length (cm) | 3.5 | 3.5 | 3.5 |
| Orifice (no./inc.) | 25 | 25 | 25 |
| Orifice diameter (in.) | $0.020^4$ | $0.020^4$ | $0.020^4$ |

| Operating Conditions | |
|---|---|
| Polymer* | Polypropylene 800 MFR |
| Die Temperature | 250° C. |
| Air Temperature | 260° C. |
| Polymer Flow Rate | 0.2 grams/orifice/min. |
| Air Flow Rate | 5 SCFM/inch |
| Coating | 10 grams/$m^2$ |
| Average Fiber Diameter | 5–10 microns |

Coating Sequence

The batt was moved through station S-1 with the long dimension (1200 mm) extended transversely across the conveyors (major axis perpendicular to the direction of batt movement), wherein the top and bottom surfaces (1200 mm×200 mm) were coated.

In the same position, the batt was moved through station S-2 wherein the side surfaces (200 mm×90 mm) were coated.

The batt was then turned 90° and moved through station S-3 with the remaining two uncoated surfaces positioned in flanking relationship with the direction of batt movement. The final two surfaces (1200 mm× 90 mm) were coated.

Batt movement through each station was approximately 20 meters/min. The entire coating process required less than one minute.

The coated batt was characterized by a complete coating (encapsulation) leaving no part of the fibrous batt exposed. The coating was generally uniform, except in the overlapped edges, and provided a durable coating. The batt could be handled easily without disintegration or disruption of the encapsulated fibrous material. The Example demonstrates the utility of the present invention in providing a durable coating which completely encapsulates the six-sided batt with thermoplastic meltblown fibers.

What is claimed is:

1. A method of coating a six-sided fibrous batt having four side surfaces and two end surfaces, which comprise the steps of:

(a) passing the batt between a first pair of meltblowing dies wherein two of the side surfaces are coated with meltblown thermoplastic fibers;

(b) passing the batt through a second pair of meltblowing dies positioned in confronting relation with the other two side surfaces of the four side surfaces wherein the other two side surfaces of the batt are coated with meltblown thermoplastic fibers;

(c) moving the batt so that the end surfaces pass in confronting relationship between a third pair of meltblowing dies wherein the two end surfaces are coated with meltblown thermoplastic fibers.

2. The method of claim 1 wherein the sequence of the steps are in the following order: (a), (b), and (c).

3. The method of claim 1 wherein the sequence of the steps are in the following order: (c), (a), and (b).

4. The method of claim 1 wherein the thermoplastic fibers are made from polyolefins.

5. The method of claim 1 wherein the thermoplastic fibers are polymers or copolymers of ethylene and propylene.

6. The method of claim 1 wherein the fibers are polypropylene.

7. The method of claim 1 wherein the average fiber size of the meltblown fibers ranges from 1 to 20 microns.

8. The method of claim 7 wherein each coating has a basis weight of 5 to 50 gr./$m^2$.

9. The method of claim 1 wherein the meltblowing dies are operative only when a surface to be coated is in line with the discharge thereof and is inoperative the rest of the time.

10. An apparatus for coating to a six-sided fibrous object having top and bottom surfaces, two side surfaces, and two end surfaces which comprise:

(a) conveyor means for moving the object in a linear direction;

(b) a first coating station comprising a pair of meltblowing dies positioned on opposite sides of the conveyor means and sized to coat two opposite side surfaces as the object moves therethrough;

(c) a second coating station comprising a pair of meltblowing dies positioned above and below the conveyor means and sized to coat the top and bottom surfaces;

(d) conveyor means for moving the object to a position wherein the two end surfaces become flanking surfaces with respect to direction of movement; and (e) a third coating station comprising a pair of meltblowing dies positioned on opposite sides of the conveyor means recited in (d) to coat the flanking surfaces.

11. The apparatus of claim 10, further comprising means for activating the dies of the coating stations in timed relation to the movement of the batt so that the dies of each station dispense meltblown coatings only while the batt passes through the station, whereby the first, second, and third coating stations are activated sequentially.

12. A method for applying a meltblown coating to a six-sided fibrous batt which has four side surfaces and two end surfaces, comprising:

(a) moving the batt through a first coating station comprising a pair of meltblowing dies disposed on opposite sides of the batt;

(b) meltblowing fibers from the meltblowing dies of the first coating station to deposit a meltblown fibrous coating onto opposite side surfaces of the batt;

(c) moving the batt with the two opposite side surfaces coated into a second coating station comprising a pair of meltblowing dies disposed on opposite sides of the batt and at right angles to the dies of the first coating station, whereby the uncoated pair of opposite side surfaces of the batt are in confronting relation with the dies of the second station;

(d) meltblowing fibers from the dies of the second coating station to deposit a meltblown coating onto the opposite uncoated side surfaces of the batt, the coatings so deposited overlapping with the coatings applied in step (b) along the edges of the batt;

(e) moving the batt so that the opposite uncoated end surfaces of the batt are in confronting relation to a third coating station comprising a pair of meltblowing dies disposed on opposite sides of the batt; and (f) meltblowing fibers from the dies of the third station to deposit a meltblown coating onto the opposite end surfaces, the coating so deposited overlapping with the coatings applied in steps (b) and (d) along the edges of the batt, whereby the batt is encapsulated in meltblown material.

* * * * *